US006120314A

United States Patent [19]

Harting et al.

[11] Patent Number: 6,120,314

[45] Date of Patent: Sep. 19, 2000

[54] PLUG CONNECTOR

[75] Inventors: Dietmar Harting, Espelkamp, Germany; Bob Mouissie, Berlicum, Netherlands

[73] Assignee: Harting KGaA, Espelkamp, Germany

[21] Appl. No.: 09/299,552

[22] Filed: Apr. 22, 1999

[30] Foreign Application Priority Data

Apr. 24, 1998 [DE] Germany ..... 298 07 349 U

[51] Int. Cl.[7] ..... H01R 4/24

[52] U.S. Cl. ..... 439/394; 439/581

[58] Field of Search ..... 439/394, 329, 439/448, 425, 579, 63, 581

[56] References Cited

U.S. PATENT DOCUMENTS

| | | | |
|---|---|---|---|
| 3,194,877 | 7/1965 | Collier . | |
| 3,915,535 | 10/1975 | O'Keefe et al. . | |
| 4,261,632 | 4/1981 | Narozny | 339/97 C |
| 4,533,191 | 8/1985 | Blackwood . | |
| 4,701,001 | 10/1987 | Verhoeven . | |
| 5,147,215 | 9/1992 | Pritulsky | 439/344 |
| 5,154,632 | 10/1992 | Ijiri | 439/394 |
| 5,199,896 | 4/1993 | Mosquera | 439/329 |
| 5,437,562 | 8/1995 | Michael . | |
| 5,505,638 | 4/1996 | Su et al. . | |
| 5,664,968 | 9/1997 | Mickievicz . | |

FOREIGN PATENT DOCUMENTS

| | | |
|---|---|---|
| 1 928 485 | 12/1970 | Germany . |
| 33 33 973 A1 | 4/1985 | Germany . |
| 296 22 055 U 1 | 4/1997 | Germany . |

*Primary Examiner*—Lincoln Donovan
*Assistant Examiner*—Kyung S. Lee
*Attorney, Agent, or Firm*—McEachran, Jambor, Keating, Bock & Kurtz

[57] ABSTRACT

For a plug connector for the electrically conductive connection of conductor tracks on a board to at least one coaxial cable having an outer screen, wherein the plug connector has at least one insertion duct for the coaxial cable, it is proposed that the insertion duct have, over its longitudinal course, a step such that the front end region of the said insertion duct has a reduced cross-section which is less than the diameter of the screen, and that slot-type clearances for plug contacts are provided which perpendicularly intersect the insertion duct.

10 Claims, 8 Drawing Sheets

PLUG CONNECTOR

The invention relates to a plug connector according to the pre-characterising clause of claim 1, for the electrically conductive connection of conductor tracks on a board to at least one coaxial cable.

Plug connectors of this kind are used in order to permit the transmission of high-frequency signals between a board and a cable making contact with the latter.

The problem underlying the invention is to provide a plug connector which is structurally very shallow and which permits reliable contact-making.

The invention solves this problem by means of a plug connector having the features in claim 1. With regard to further advantageous refinements, reference is made to claims 2 to 10.

Through the construction of a plug connector in accordance with the invention, the said plug connector is able to receive insertion ducts which lie parallel side by side and are able to dispense with a bend in their course, and with which contact is reliably made, perpendicularly to their course, by means of inserted plug contacts. Under these circumstances, the structural height of the plug connector can be kept very small; the plug connector in the exemplified embodiment has a height of about 7 mm.

Contact-making is particularly reliable if two contacts for the screen of a coaxial cable are provided, which cut into the said screen, and an additional plug contact is provided for the central conductor.

If a tension-relieving system which is constructed integrally with the casing of the plug connector is provided, reliable holding of the cable in the plug connector is ensured with little outlay, design-wise.

It is particularly advantageous if a number of coaxial cables and single conductors, for instance for supplying voltage, are disposed in the plug connector so as to be located parallel side by side, as a result of which the structural height of the plug connector is not increased. This permits complete contact-making with the board, which can be encompassed, in a holding manner, by lateral edge formations on the plug connector.

Further advantages and details emerge from an exemplified embodiment of the subject of the invention, which is represented in the drawings.

In the latter:

FIG. 1 shows a schematised section through an insertion duct for a coaxial cable in the plug connector, FIG. 2 shows a section along the line II—II in FIG. 1, FIG. 3 shows a view of the plug connector from below, FIG. 4 shows a section along the line IV—IV in FIG. 3, FIG. 5 shows a section along the line V—V in FIG. 3, FIG. 6 shows a plan view along the line VI—VI in FIG. 3, FIG. 7 shows a single-component representation of a plug contact, in side view, FIG. 8 shows a plan view of the board, FIG. 9 shows a view, similar to that in FIG. 2, of an alternative plug connector with plug contacts, which lie in a line, for the inner conductor and for the screen.

Figure 1:
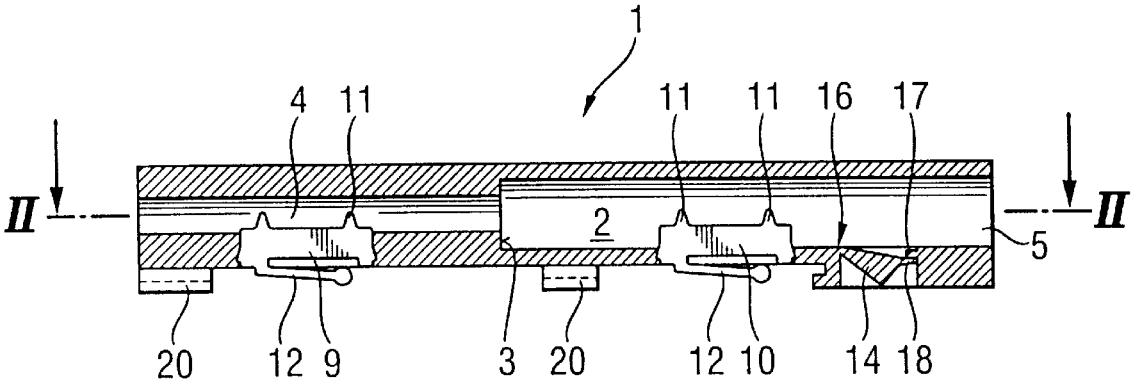
Figure 2:
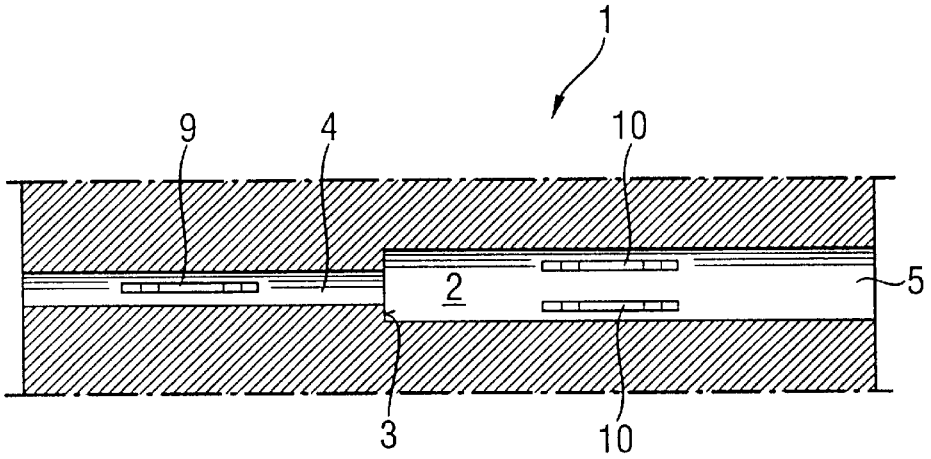
Figure 3:
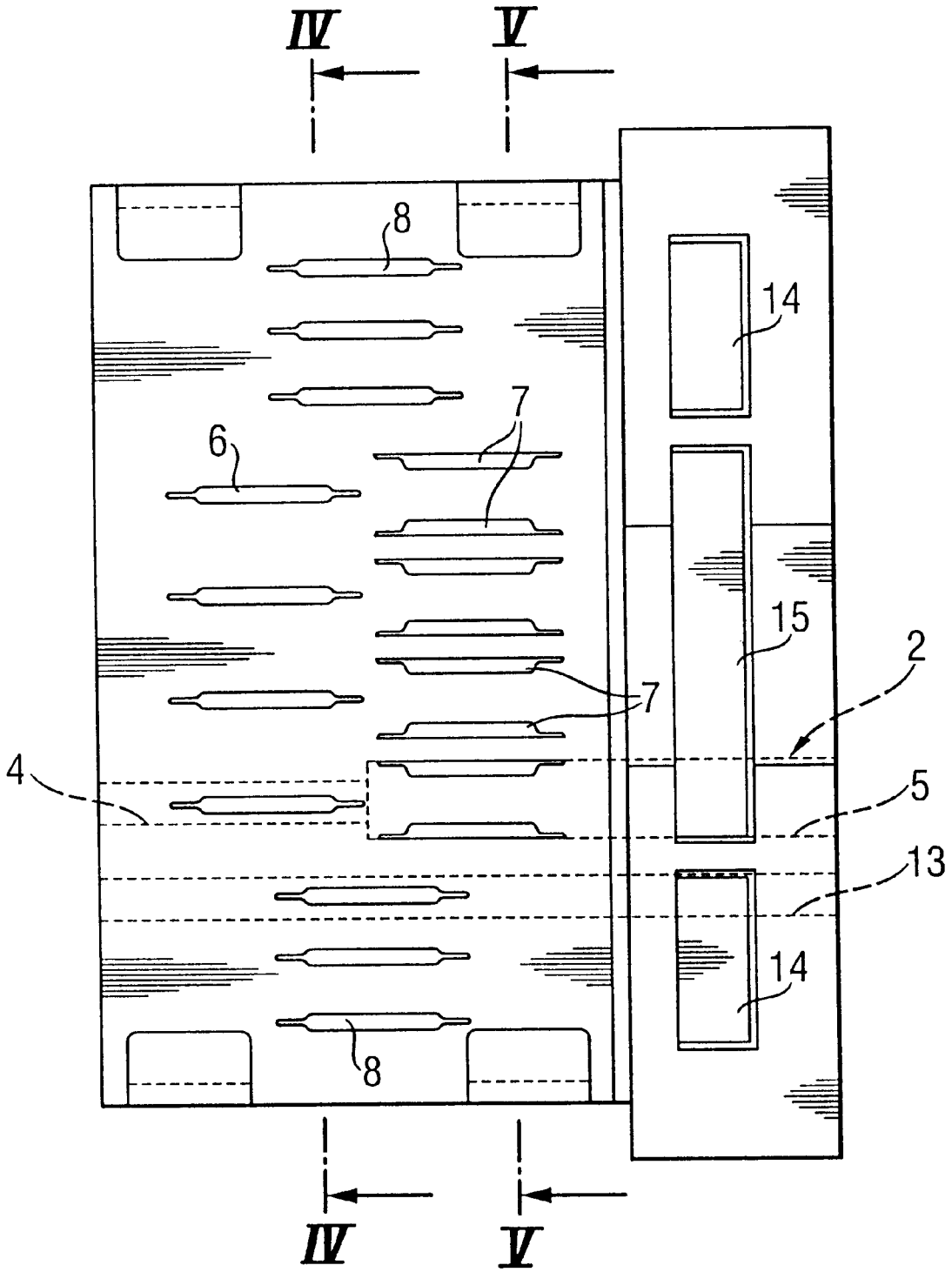
Figure 6:
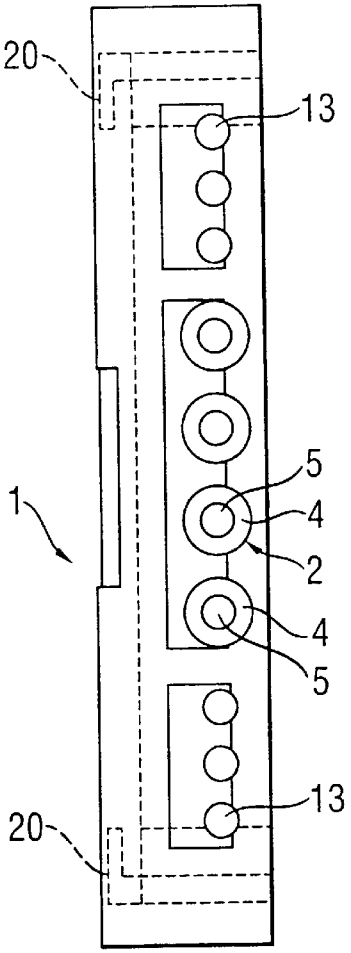
Figure 5:
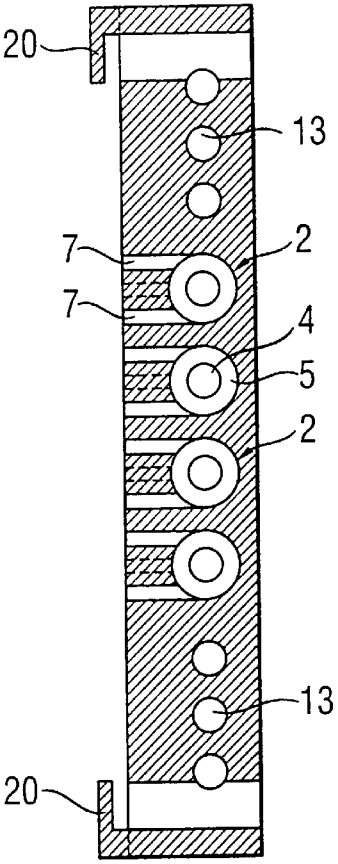
Figure 4:
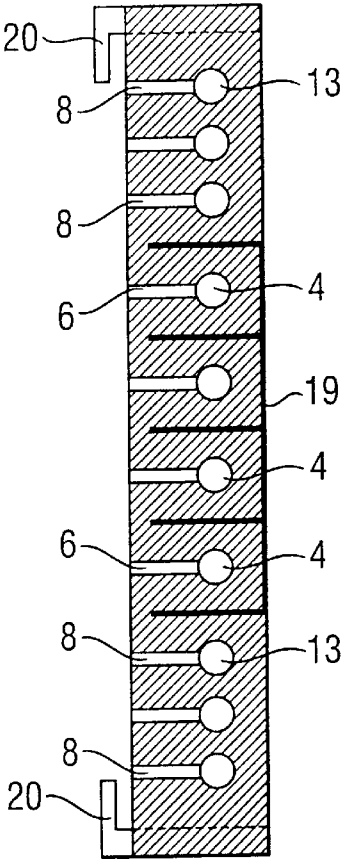
Figure 7:
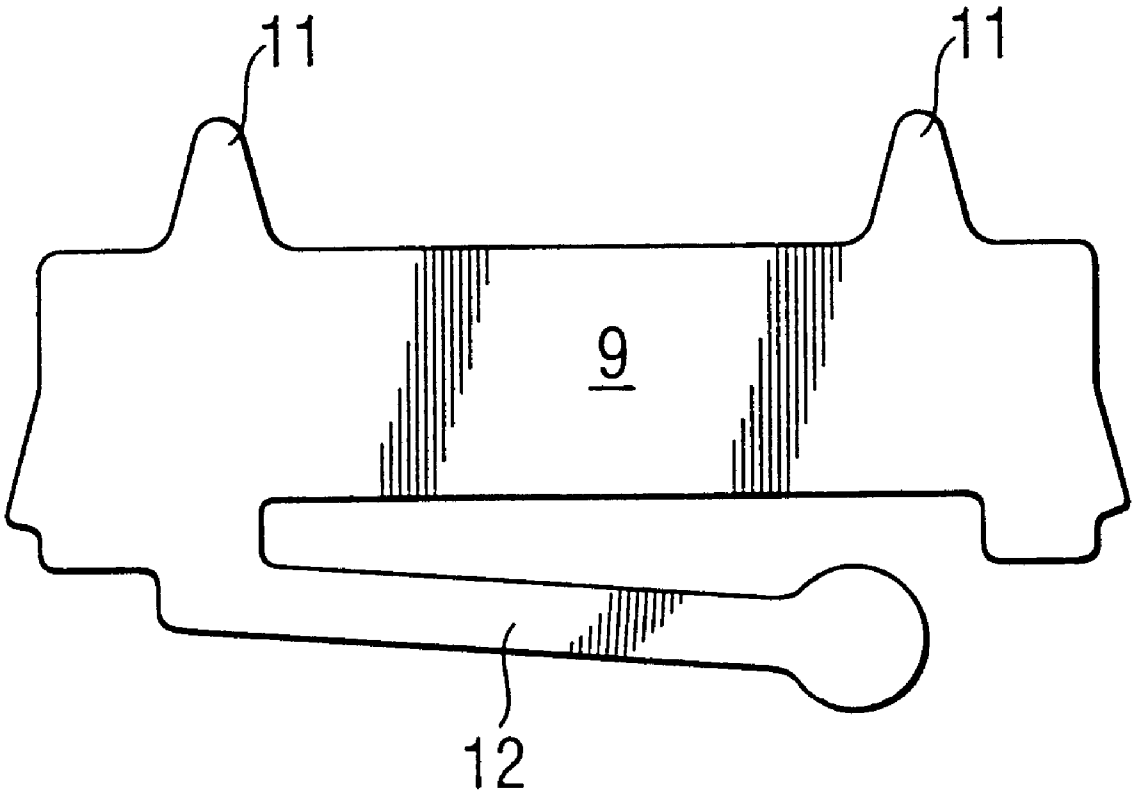
Figure 8:
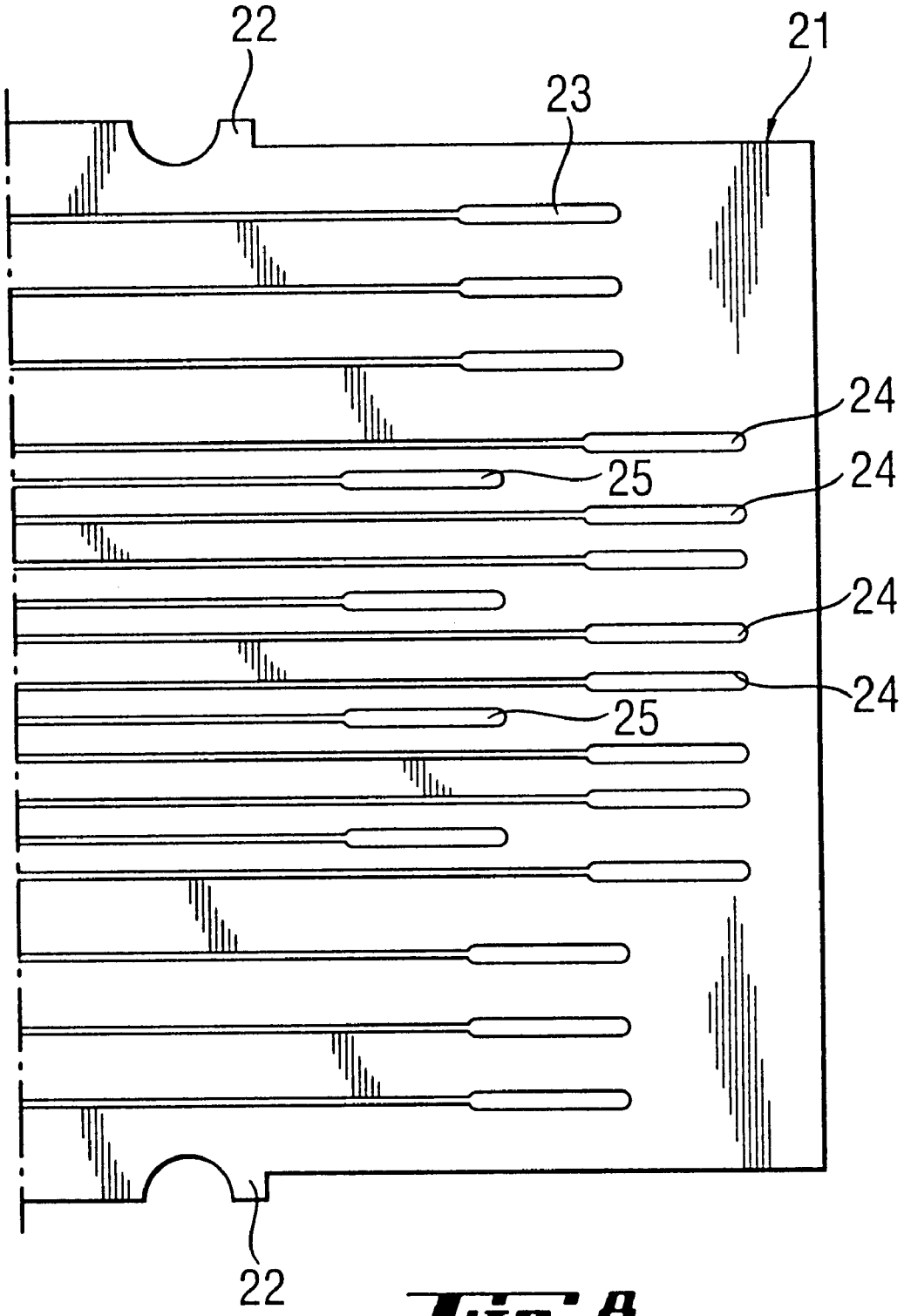

The plug connector 1, 101 represented in the drawings has, in its central region, a number of insertion ducts 2 for coaxial cables, which ducts lie side by side and have, over their longitudinal course, a step 3 in each case, which separates a front end region 4 for receiving the central inner conductor of the coaxial cable from a rear end region 5 for receiving the coaxial cable with its inner conductor and outer screen.

The front end region 4 has a reduced diameter compared with the rear end region 5, in such a way that the said diameter is less than that of the screen, so that the screen has to be removed from the coaxial cable at least over the length of the front end region 4.

Slot-type clearances 6, 7, 8 which are constructed to receive plug contacts 9, 10, are provided in the plug connector 1 according to FIGS. 1 to 8. For each insertion duct 2, there are provided a slot-type clearance 6 associated with the front end region 4, and also two slot-type clearances 7 associated with the rear end region 5, the slot-type clearance 6 intersecting the central conductor radially in relation to the end region 4 of the insertion duct 2. The two rear slot-type clearances 7 are disposed in such a way that the plug contacts 10 to be inserted at that point intersect the screen of the coaxial cable substantially tangentially. For contact-making purposes, the coaxial cables are first of all inserted in the insertion duct 2, after partial removal of the screen, whereupon the plug contacts 9, 10 are pressed into the slot-type clearances 6, 7, as a result of which the relevant conductors are cut into and thereby conductively connected to the said plug contacts 9, 10. For this purpose, the plug contacts 9, 10 have at least one point 11 in each case. On the opposite side, the plug contacts 9, 10 are provided with spring clips 12 which exert, on the relevant conductor track 23, 24, 25 on the board 21, a pressure which ensures reliable contact-making.

In the exemplified embodiment, the plug contacts 9, 10 for the inner conductor and for the screen respectively have the same kind of construction, so that it is only necessary to make available one type of component for this purpose.

In addition to the central insertion ducts 2, of which there are four in the exemplified embodiment, for coaxial cables, the plug connector 1, 101 has, in its outer regions and in the same plane as the said insertion ducts 2, three additional line ducts 13 which receive single-core cables, for example for supplying voltage or for transmitting a low-frequency signal. The additional line ducts 13 lie symmetrically to the insertion ducts 2 and likewise have slot-type clearances 8 which are provided for the introduction of plug contacts. These may have the same kind of construction as the other plug contacts 9, 10 used.

In the rear region of the plug, tension-relieving systems 14, 15 are provided, both for the lateral line ducts 13 and also for the central coaxial insertion ducts 2. When the casing of the plug connector 1 is constructed as a single part, for example as a plastic casing, the tension-relieving system 14 or 15 is constructed in one piece with the casing in each case, and can be pivoted about a film hinge 16 into a closed position in which it is secured behind a counter-edge 17 and holds the cable in the relevant duct 2, 13 in a force-locking manner with the aid of a point 18. As a result of being in one piece with the casing, a tension-relieving system 14, 15 of this kind is particularly inexpensive to manufacture.

When high-frequency signals, particularly in the range of frequencies which are greater than 1 GHz, are transmitted, a screening comb 19 is provided, which is constructed from electrically conductive material and separates the insertion ducts 2 from one another, in order to thereby prevent signal transmission between the coaxial conductors.

The plug connector 1, 101 has projections 20 on the underside which engage round the edge region of a board 21 and thereby hold the plug connector 1 on the board 21. The board may have projections 22 which constitute a stop for the plug connector 1, 101 which is to be pushed on. The conductor tracks 23, 24, 25 on the board, which are in contact with the plug connector 1, 101, are matched to the corresponding arrangement on the plug connector; that is to say, two conductor tracks 24, in each case, for making contact with the screen are located symmetrically to a central conductor track 25 for making contact with the inner conductor. Extending in the outer region are three conductor tracks 23, in each case, for the low-frequency single conductors or single conductors transmitting a direct-current voltage, which are inserted in the line ducts 13.

Figure 9:
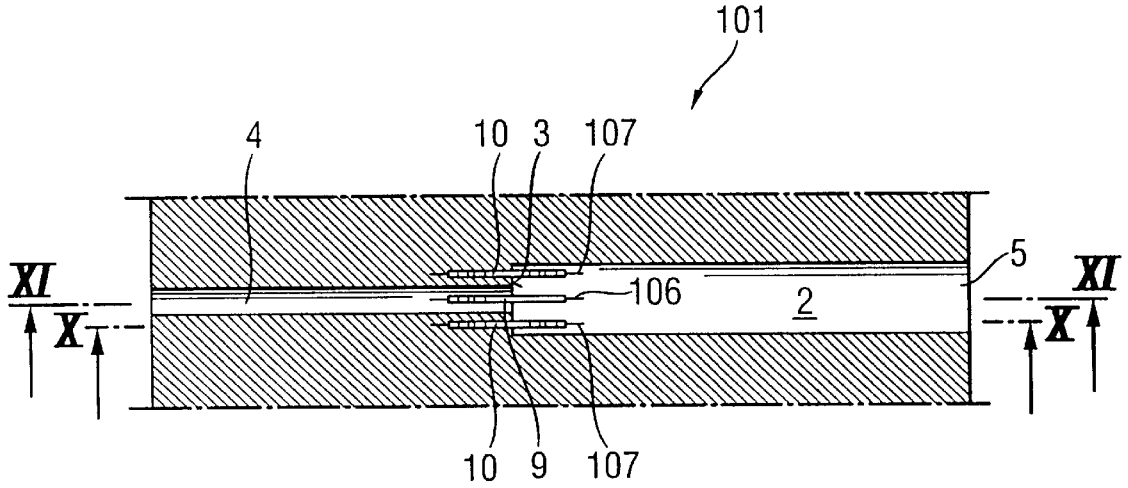
Figure 10:
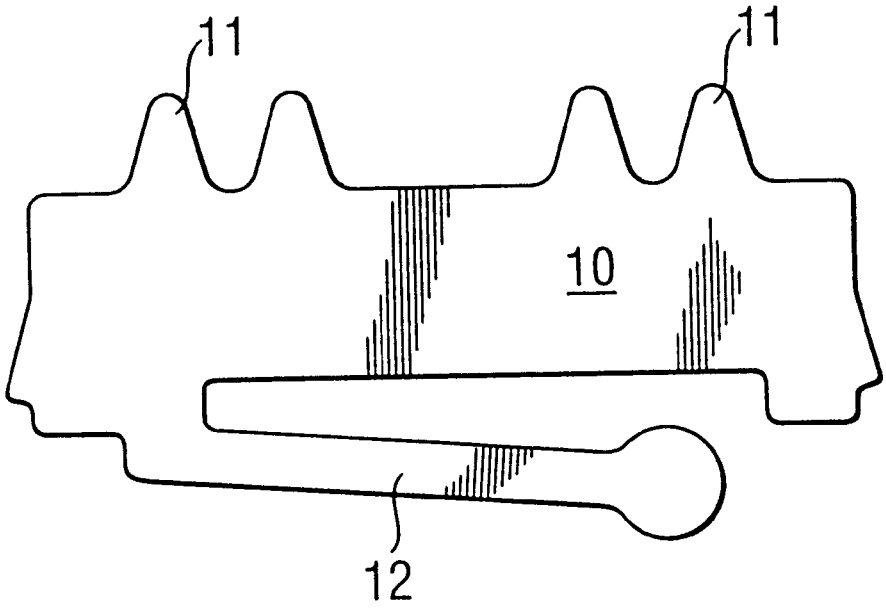
FIG. 10 shows a section along the line X—X in FIG. 9.

According to an alternative exemplified embodiment (FIGS. 9 to 11), the three plug contacts 9, 10 are disposed side by side at one axial level in the plug connector 101, although the construction is otherwise of the same kind as in the first exemplified embodiment.

In this arrangement, too, the central plug contact 9 makes contact with the central conductor in the front region 4 of the insertion duct 2, but the outer plug contacts 10 make contact with the outer screen in the rear region 5 of the insertion duct 2. The screening behaviour is improved as a result of the plug contacts 9, 10 being located side by side in this way. The outer plug contacts 10 have contact points 11 which extend into the widened region of the insertion duct 2, so that the outer screen of the cable pressed in can be cut into, and made contact with, at this point. The points 11 associated with the narrower region 4 of the insertion duct 2 have no contact effect in this instance, since they lie next to the inner conductor. These points 11 could even be removed.

Figure 11:
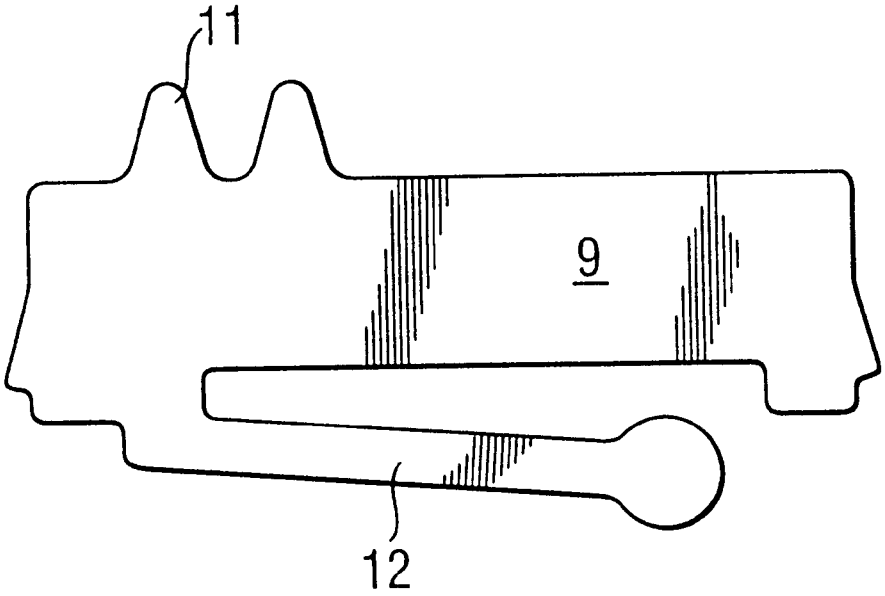
FIG. 11 shows a section along the line XI—XI in FIG. 9.

As shown in FIG. 11, on the other hand, the plug contact 9 for making contact with the central conductor in the front region 4 of the insertion duct 2 has contact points 11 only in that part which faces towards the front region 4, but these points may, for example, be nipped off in the other lateral region of the plug contact, so that in spite of this difference, use may be made of a series of plug contacts 9, 10 which is initially of the same kind. When the plug contact 9 is pressed into the slot-type clearance 106 which lies in a line with the outer slot-type clearances 107, contact is then made only with the central inner conductor in the front region 4 and, in the absence of contact points, the screen is not cut into and therefore contact is likewise not made with it.

Figure 12:
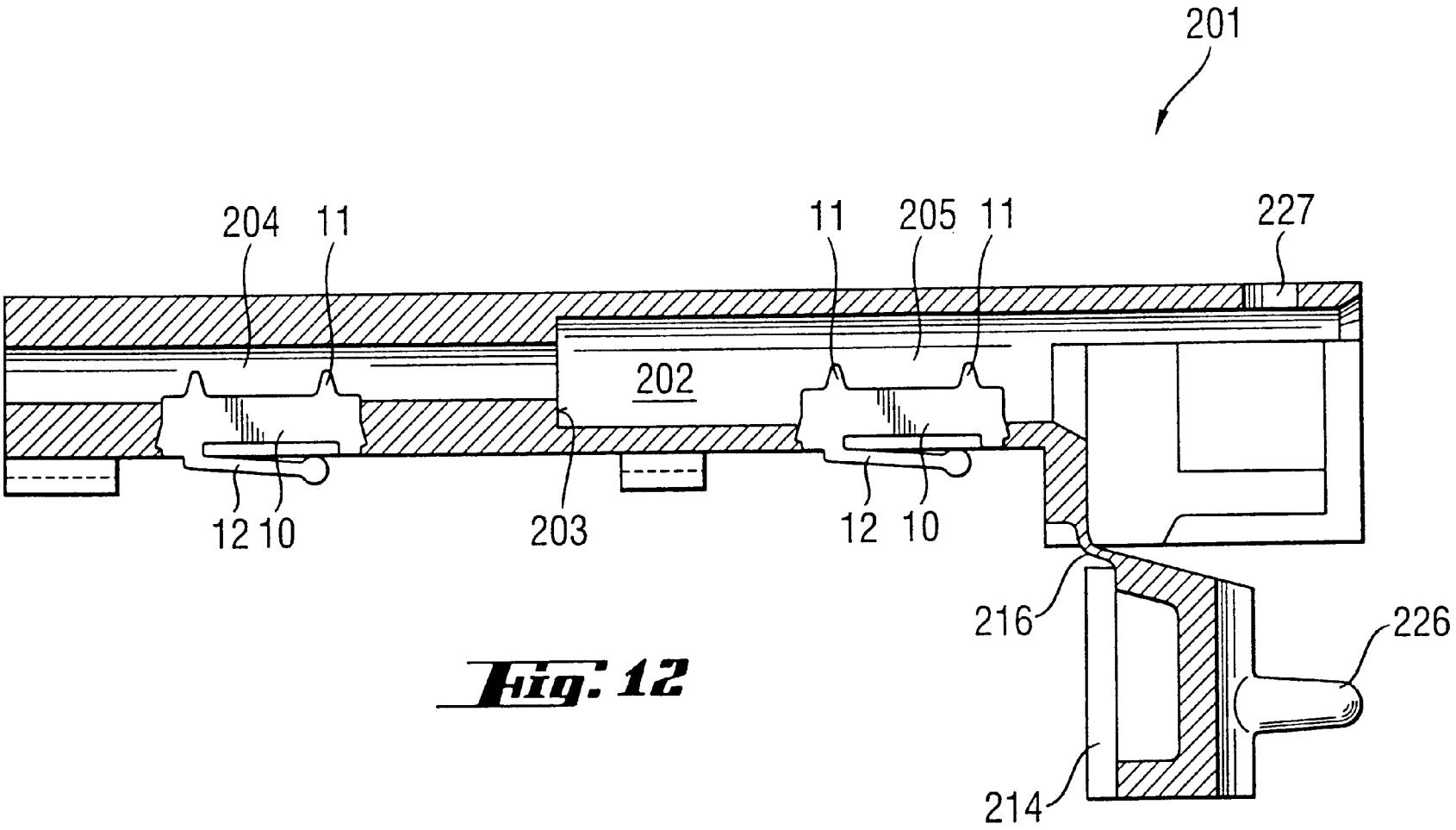
FIG. 12 shows a sectional view of a plug connector with a modified tension-relieving system.

FIG. 12 shows a plug connector 201 which has a modified tension-relieving system 214 and is constructed substantially like the plug connector represented in FIG. 1 and described above. The tension-relieving system is so designed, however, that it forms the termination of the plug casing when in the pivoted-in condition.

In this connection, FIG. 12 shows a section through the plug connector with the insertion duct 202 which is subdivided into the rear, widened-out region 205 and the front region 204.

The tension-relieving system 214, which is held by means of a film hinge 216 moulded onto the outer edge of the casing, is provided with conically shaped pins 226 (of which only one is represented here in an exemplary manner), which penetrate, when the tension-relieving system is closed, into clearances 227 in the opposite wall of the casing, and of which the end, which may optionally protrude, may be welded to the wall of the casing by a thermal process (welding with pre- and postheating) in order to guarantee permanent clamping of a cable.

The conically shaped pins 226 are disposed side by side horizontally in such a way that, when the tension-relieving system is closed, they are pushed, in each case, into interstices in the cables or coaxial cables and clamp the said cables fast because of their bevelled profiling, the intervals between, and size of the conically shaped pins 226 being matched to the different diameters of the coaxial cables and single conductors.

What is claimed is:

1. Plug connector (1; 101) for the electrically conductive connection of conductor tracks (24; 25) on a board (21) to at least one coaxial cable having an outer screen, wherein the plug connector (1; 101) has at least one insertion duct (2) for the coaxial cable, characterized in that the insertion duct (2) has, over its longitudinal course, a step (3) such that the frontal end region (4) of the said insertion duct has a reduced cross-section which is less than the diameter of the screen, and that slot-type clearances (6, 7; 106, 107) for plug contacts (9; 10) are provided which perpendicularly intersect the insertion duct (2);

wherein the slot-type clearances (6, 7; 106, 107) having plug contacts (9, 10) are provided for a coaxial cable, of which plug contacts one (9) makes contact with the central conductor in the front region (4) of the insertion duct (2), and two plug contacts (10) make contact with the outer screen in a rear region (5) of the insertion duct (2);

the plug contacts (9, 10) are provide, in each case, with at least one point (11) for making contact with the cable, and have, opposite the said point (11), at least one spring clip (12) for contact pressure on a conductor track (23; 24; 25) on a board (21).

2. Plug connector according to claim 1, characterized in that the plug connector (1; 101) has, in its rear region, a tension-relieving system (14; 15) which is secured by a film hinge (16) and can be pivoted about the latter.

3. Plug connector according to claim 1, characterized in that the tension-relieving system (214) is provided with conically-shaped pins (226), and that the pins project into clearances (227) after the pivoting of the tension-relieving system (214).

4. Plug connector according to claim 3, characterized in that the conically-shaped pins (226) can be welded in the clearances (227).

5. Plug connector according to claim 1, characterized in that the plug contacts (9, 10) for making contact with the inner conductor and the screen have the same kind of construction.

6. Plug connector according to claim 1, characterized in that the plug connector (1; 101) has, parallel to the insertion ducts (2) for the coaxial cables, at least one additional line duct (13) for a single electrical conductor, which is provided with a plug contact via a slot-type clearance (8).

7. Plug connector according to claim 6, characterized in that the line ducts (13) for the single conductors are disposed in the edge region of the plug connect or (1; 101) and have, in each case, a tension-relieving system (14) of their own which is separate from the tension-relieving system (15) for the coaxial cable or cables.

8. Plug connector according to claim 7, characterized in that a number of insertion ducts (2) for coaxial cables are provided and the latter are separated from one another by a metal screening comb (19) which separates the insertion ducts from one another.

9. Plug connector according to claim 8, characterized in that the plug connector (1; 101) has, in its central region, four insertion ducts (2) for coaxial cables and, lying symmetrically thereto at the edge regions, three line ducts (13) in each case for single electrical conductors.

10. Plug connector according to claim 9 characterized in that the slot-type clearances (6, 7, 8) for the plug contacts (9, 10) of the insertion ducts (2) lie in one plane.

* * * * *